US005603383A

United States Patent [19]

Wentworth et al.

[11] Patent Number: 5,603,383

[45] Date of Patent: Feb. 18, 1997

[54] REVERSIBLE PNEUMATIC GROUND PIERCING TOOL

[75] Inventors: Steven W. Wentworth, Brookfield; Robert Crane, Oconomowoc; Mark Randa, Muskego, all of Wis.

[73] Assignee: Earth Tool Corporation, Oconomowoc, Wis.

[21] Appl. No.: 533,323

[22] Filed: Sep. 25, 1995

[51] Int. Cl.[6] ..... E21B 4/14

[52] U.S. Cl. ..... 173/91; 173/137; 173/211; 175/19

[58] Field of Search ..... 173/91, 210, 211, 173/17, 134, 137; 175/19

[56] References Cited

U.S. PATENT DOCUMENTS

| | | | |
|---|---|---|---|
| 4,618,007 | 10/1986 | Kayes . | |
| 4,629,008 | 12/1986 | Kostylev . | |
| 4,662,457 | 5/1987 | Bouplon . | |
| 4,840,237 | 6/1989 | Roemer | 173/91 |
| 4,953,626 | 9/1990 | Püttmann et al. | 173/91 |
| 5,025,868 | 6/1991 | Wentworth . | |
| 5,086,848 | 2/1992 | Hudak | 173/91 |
| 5,172,771 | 12/1992 | Wilson | 173/91 |
| 5,199,151 | 4/1993 | Wentworth . | |
| 5,318,135 | 6/1994 | Kayes . | |
| 5,337,837 | 8/1994 | Wentworth et al. | 173/91 |

FOREIGN PATENT DOCUMENTS 1170167 11/1969 United Kingdom .

*Primary Examiner*—Scott A. Smith
*Attorney, Agent, or Firm*—Foley & Lardner

[57] ABSTRACT

A pneumatic ground piercing tool according to the invention has a reversing mechanism provided as part of the air distributing mechanism. Such a tool includes an elongated tubular housing having a rear opening, a head assembly including an anvil, a striker disposed for reciprocation within an internal chamber of the housing to impart impacts to a rear impact surface of the anvil for driving the body through the ground, an air distributing mechanism for effecting reciprocation of the striker, and a tail assembly mounted in a rear end opening of the housing that secures the striker and air distributing mechanism in the housing. In one embodiment, the outer bushing of the valve sleeve can slide a short distance relative to the air supply tube and has an intermediate radial port which selectively communicates with the air supply conduit. The valve sleeve also includes a detent mechanism for securing the air supply tube in its forward or reverse position. A biasing device such as an resilient tube biases the detent mechanism to an unlocked position when the compressed air is off, and is overcome by air pressure so that the detent assumes a locked position when the compressed air is on.

10 Claims, 2 Drawing Sheets

REVERSIBLE PNEUMATIC GROUND PIERCING TOOL

TECHNICAL FIELD

This invention relates to pneumatic impact tools, particularly to self-propelled ground piercing tools.

BACKGROUND OF THE INVENTION

Self-propelled pneumatic tools are used to form holes for pipes or cables beneath roadways without need for digging a trench across the roadway. These tools include, as general components, a torpedo-shaped body having a tapered nose and an open rear end, an air supply hose which enters the rear of the tool and connects it to an air compressor, a piston or striker disposed for reciprocal movement within the tool, and an air distributing mechanism for causing the striker to move rapidly back and forth. The striker impacts against the front wall (anvil) of the interior of the tool body, causing the tool to move violently forward into the soil. The friction between the outside of the tool body and the surrounding soil tends to hold the tool in place as the striker moves back for another blow, resulting in incremental forward movement through the soil. Exhaust passages are provided in the tail assembly of the tool to allow spent compressed air to escape into the atmosphere.

Most impact boring tools of this type have a valveless air distributing mechanism which utilizes a stepped air inlet. The step of the air inlet is in sliding, sealing contact with a tubular cavity in the rear of the striker. The striker has radial passages through the tubular wall surrounding this cavity, and an outer bearing surface of enlarged diameter at the rear end of the striker. This bearing surface engages the inner surface of the tool body.

Air fed into the tool enters the cavity in the striker through the air inlet, creating a constant pressure which urges the striker forward. When the striker has moved forward sufficiently far so that the radial passages clear the front end of the step, compressed air enters the space between the striker and the body ahead of the bearing surface at the rear of the striker. Since the cross-sectional area of the front of the striker is greater than the cross-sectional area of its rear cavity, the net force exerted by the compressed air now urges the striker backwards instead of forwards. This generally happens just after the striker has imparted a blow to the anvil at the front of the tool.

As the striker moves rearward, the radial holes pass back over the step and isolate the front chamber of the tool from the compressed air supply. The momentum of the striker carries it rearward until the radial holes clear the rear end of the step. At this time the pressure in the front chamber is relieved because the air therein rushes out through the radial holes and passes through exhaust passages at the rear of the tool into the atmosphere. The pressure in the rear cavity of the striker, which defines a constant pressure chamber together with the stepped air inlet, then causes the striker to move forwardly again, and the cycle is repeated.

In some prior tools, the air inlet includes a separate air inlet pipe, which is secured to the body by a radial flange having exhaust holes therethrough, and a stepped bushing connected to the air inlet pipe by a flexible hose. These tools have been made reversible by providing a threaded connection between the air inlet sleeve and the surrounding structure which holds the air inlet concentric with the tool body. The threaded connection allows the operator to rotate the air supply hose and thereby displace the stepped air inlet rearward relative to the striker. Since the stroke of the striker is determined by the position of the step, i.e., the positions at which the radial holes are uncovered, rearward displacement of the stepped air inlet causes the striker to hit against the tail nut at the rear of the tool instead of the front anvil, driving the tool rearward out of the hole.

Wentworth et al. U.S. Pat. No. 5,025,868 describes a ground-piercing tool having an improved form of screw-reverse mechanism, a striker having annular bearing rings at each end, and a removable, axially clamp-loaded end-cap assembly that facilitates repair and reassembly of the tool. Wentworth et al. U.S. Pat. No. 5,199,151 describes a tool of similar construction wherein the tool body is made by rotary swaging rather than by machining a solid metal bar.

A common disadvantage of the known screw reverse mechanism is the need to rotate the hose through several revolutions in order switch from forward to reverse mode. This must be done manually and can be difficult when the tool has travelled a long distance because of the length of hose that must be twisted. As a result, several improved forms of ground piercing tools have been developed that provide mechanisms for a quarter- or half-turn to switch from forward to reverse mode. See generally Bouplon U.S. Pat. No. 4,662,457, Jenne U.S. Pat. No. 5,307,883, and Kayes U.S. Pat. No. 4,618,007. Kayes U.S. Pat. No. 5,318,135 in particular provides a reversing mechanism that relies on an air supply tube having a side opening that can be selectively rotated into alignment with the radial port normally provided in the striker in order to introduce compressed air prematurely into the forward chamber of the tool in order to shorten the forward stroke of the striker for reverse travel. A resilient detent mechanism is provided as part of the tail assembly for locking the inner tube into its operative positions. These devices have proven useful in practice but are generally more complex and hence more expensive to manufacture than the basic screw reverse mechanism.

SUMMARY OF THE INVENTION

The present invention provides a simple and reliable reversing mechanism that can be switched from forward to reverse with a twist of the air hose over a short distance. A pneumatic ground piercing tool according to the invention includes an elongated body including a tubular housing and an anvil disposed at a front end of the housing, a striker disposed for reciprocation within an internal chamber of the housing to impart impacts to a rear impact surface of the anvil for driving the tool forwardly through the ground, an air distributing mechanism for effecting reciprocation of the striker, including a stepped air inlet conduit slidably disposed in a rearwardly opening recess in the striker, and a radial hole extending through a wall in the striker from the rearwardly opening recess, a tail assembly mounted in a rear end opening of the housing that secures the striker and air distributing mechanism in the housing, and a reversing mechanism incorporated into the air distributing mechanism. The stepped conduit of the air distributing mechanism includes a substantially rigid air supply tube rotatably mounted in the tail assembly, which tube supplies compressed air to the rearwardly opening recess in the striker. A bushing is slidably disposed on a forward end of the tube on its inside and the rearwardly opening recess of the striker on its outside. To limit travel of the bushing relative to the air supply tube, a stop mechanism may be provided that limits sliding movement of the bushing relative to the air supply tube.

The reversing valve can be opened and closed by rotating the air supply tube to supply compressed air to a first port located along a midportion of the bushing. Suitable means such as a resilient tube surrounding the air supply tube biases the bushing to a forward position relative to the tube when the rearwardly opening recess in the striker is depressurized. This biasing force is overcome by compressed air pressure when compressed air is supplied through the conduit to the rearwardly opening recess in the striker so that the bushing slides to a rearward position relative to the air supply tube. A detent mechanism secures the bushing from rotation relative to the air supply tube while the rearwardly opening recess in the striker is pressurized, and releases when the bushing slides forward under the force of the biasing means, permitting rotation of the inner tube relative to the bushing while the rearwardly opening recess in the striker is depressurized.

According to a preferred form of the invention, the detent mechanism comprises a radial pin extending from near the front end of the air supply tube engaged in a U-shaped groove in the valve sleeve. When the compressed air is turned off, the biasing device pushes the valve sleeve forward a short distance relative to the inner tube, enabling the operator to twist the inner tube so that the pin travels along the circumferential midportion of the groove. When the compressed air is turned back on, the force of the air pushes the valve sleeve a short distance rearwardly relative to the inner tube, thereby engaging the pin in one of the end portions of the slot. As long as the compressed air remains on, the pin secures the inner tube in the selected position.

Other objects, features and advantages of the invention will become apparent from the following detailed description. It should be understood, however, that the detailed description is given by way of illustration only, since various changes and modifications within the spirit and scope of the invention will become apparent to those skilled in the art from this detailed description.

BRIEF DESCRIPTION OF THE DRAWING

The invention will hereafter be described with reference to the accompanying drawing, wherein like numerals denote like elements, and.

DETAILED DESCRIPTION OF PREFERRED EMBODIMENTS

Figure 6:
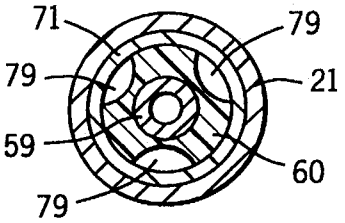
FIG. 6 is a cross-sectional view taken along the line VI—VI in FIG. 1.
Figure 1:
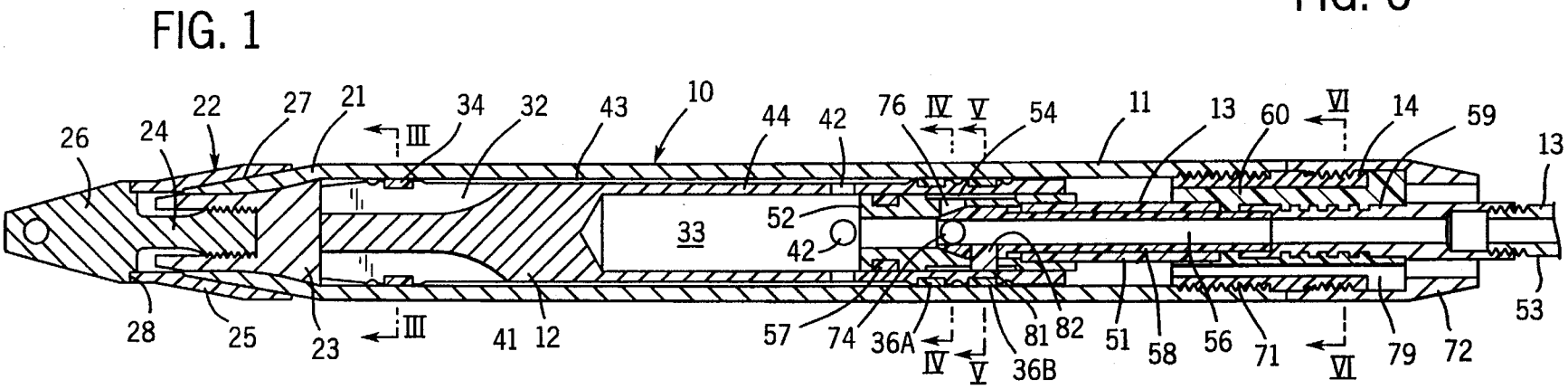
FIG. 1 is a lengthwise sectional view of an impact tool according to the invention in forward mode position.
Figure 5:
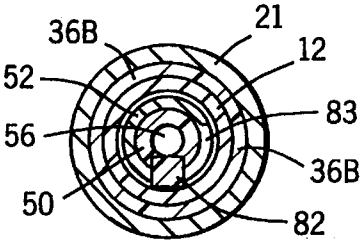
FIG. 5 is a cross-sectional view taken along the line V—V in FIG. 1.
Figure 4:
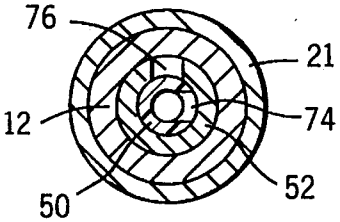
FIG. 4 is a cross-sectional view taken along the line IV—IV in FIG. 1.
Figure 3:
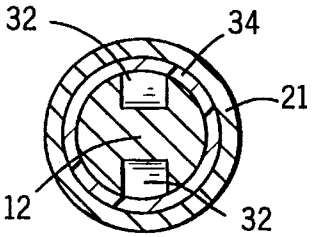
FIG. 3 is a cross-sectional view taken along the line III—III in FIG. 1.

Referring now to FIGS. 1 to 7, a pneumatic ground piercing tool 10 according to the invention includes, as main components, a tool body 11 which includes a housing 21 and head assembly 22, a striker 12 for impacting against the interior of body 11 to drive the tool forward, a stepped air inlet conduit 13 which cooperates with striker 12 for forming an air distributing mechanism for supplying compressed air to reciprocate striker 12, and a tail assembly 14 which allows exhaust air to escape from the tool and secures conduit 13 to body 11. Stepped air inlet conduit 13 includes a resilient plastic or elastomeric outer tube 51 disposed about an inner air supply tube 50 and a tubular bushing 52 forming the step of the main valve mechanism. A reversing mechanism 54 in the form of a secondary valve mechanism is provided on the forward end of tube 50 and the midportion of bushing 52 as described hereafter. Tail assembly 14 includes a tail nut (rear anvil) 71 that serves to secure an end cap 72 to the rear end of the body 11.

Striker 12 is disposed for sliding, back-and-forth movement inside of tool body 11 forwardly of conduit 13 and tail assembly 14. Striker 12 comprises a generally cylindrical rod having a rearwardly opening blind hole (recess) 33 and a pair of frontwardly extending grooves 32 for conducting compressed air to the front end of the forward pressure chamber. Plastic, front and rear seal bearing rings 34, 36A and 36B are disposed in corresponding annular grooves in the outer periphery of striker 12 for movement along the inner surface of housing 21. The front impact surface of striker 12 impacts against anvil 23 when the tool is in forward mode, and an annular rear impact surface of the striker impacts against tail nut 71 when the tool is in rearward mode.

A plurality of rear radial holes 42 through a wall 44 surrounding recess 33 allow communication between recess 33 and an annular space 43 between striker 12 and housing 21 bounded by seal rings 34, 36A. Annular space 43, front grooves 32 and the interior space of body 11 ahead of rings 34 together comprise the front, variable-volume pressure chamber of the tool.

An axial bore 56 which extends through conduit 13 and bushing 52 allows compressed air to pass from a fitting 53 of the air supply hose (not shown) to recess 33. The cylindrical outer surface of bushing 52 is inserted into recess 33 in slidable, sealing engagement with the wall thereof. Recess 33 and the adjoining interior space of stepped conduit 13 together comprise a rear, constant pressure chamber which communicates intermittently with the front, variable pressure chamber by means of holes 42. Bushing 52 may, if needed, have a plastic bearing ring 57 disposed in an annular peripheral groove to reduce air leakage between bushing 52 and the wall of cavity 33. Bushing 52 is preferably made of a light-weight material such as plastic.

A detachable head 26 has a rearwardly extending, externally threaded shank 24 disposed in a threaded, frontwardly opening hole in anvil 23. A sleeve 25 having forwardly tapering inner and outer surfaces is clamped between a frontwardly tapering nose portion 27 of housing 21 and a rearwardly facing annular step on the outer periphery of head 26.

Tail assembly 14 includes tail nut (rear anvil) 71 that serves to secure end cap 72 to the rear end of the housing 21 by means of respective threaded connections. Tube 50 comprises a front section in the form of a plastic inner tube section 58 coupled at its rear end to a rear steel inlet pipe or tube section 59. The rear end of plastic inner tube section 58 is press-fitted into a forwardly opening socket 55 in rear tube section 59, and the front end is similarly press-fitted or bonded into a rearwardly opening counterbore 65 in bushing 52 as shown. Outer resilient tube 51 is in close conforming contact with the exterior of inner tube section 58, but does not prevent rotation of tube 50. Inner tube section 58 is preferably made of a plastic that is generally rigid but has enough flexibility to compensate for centerline misalignment between valve (bushing 52) and the striker.

Figure 2:
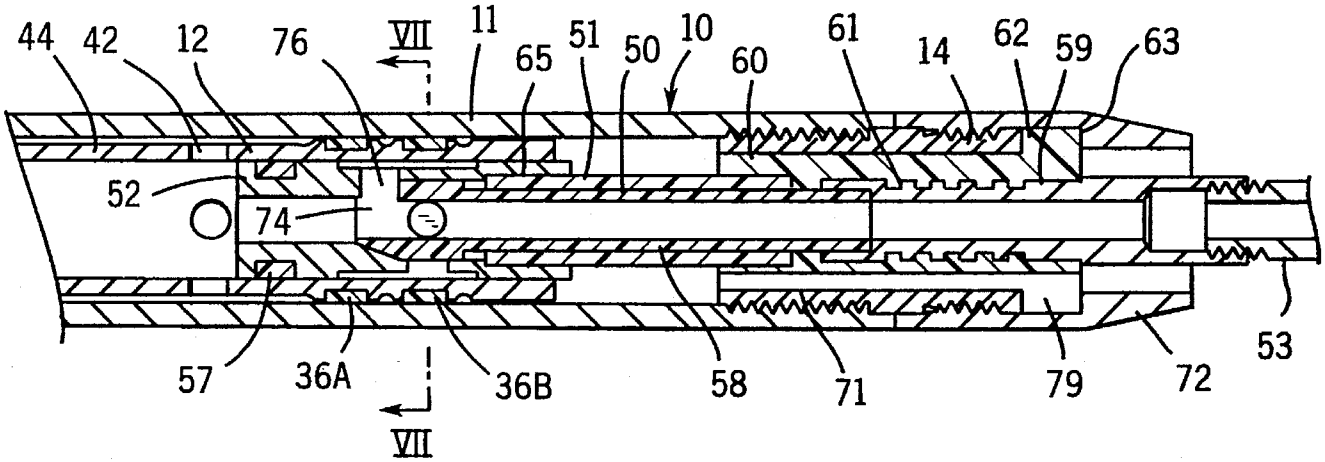
FIG. 2 is an enlarged sectional view of the rear end of the tool shown in FIG. 1, in rearward mode position.

A resilient, generally cylindrical plastic or elastomeric isolator 60 is disposed between tail nut 71 and tube 50 as shown in FIG. 2. Rear tube section 59 has a series of spaced, circumferential lands 61 on its exterior surface which form corresponding grooves between them. Isolator 60 may be formed by injection with nut 71 and tube 50 in place so that flowable plastic fills in the grooves between lands 61, embedding the lands in the isolator material and thereby securing tube 50 against lengthwise movement, although tube 50 remains free to turn inside isolator 60 without moving in the lengthwise direction of the tool.

A rear radial flange 62 of isolator 60 is clamped between a frontwardly facing inner step 63 of end cap 72 and a rear edge of tail nut 71. Isolator 60 has external longitudinal grooves therein which act as exhaust passages 79 for compressed air expelled from holes 42 when holes 42 clear the rear edge of bushing 52 during the rearward stroke of striker 12.

Reversing mechanism 54 is incorporated into the air distributing mechanism. Inner tube 58 has a side port 74 located near its front end. Bushing 52 has a radial port 76 therein approximately midway along its length. Port 74 can be brought into alignment with port 76 by twisting tube 50 to the position shown in FIG. 2, thereby permitting compressed air to pass into the forward pressure chamber once port 76 comes into communication with radial hole 42 in the striker. As noted above, this early release of compressed air into the forward pressure chamber shortens the forward strike of the striker and causes it to impact on tail nut 71 instead of anvil 23. Rotating tube 50 to the position shown in FIGS. 1 and 4 moves port 76 out of alignment with port 74 so that the tool operates in forward travel mode.

A detent mechanism 81 is provided to ensure that tube 50 does not rotate during operation out of its predetermined forward and reverse travel positions. Detent mechanism 81 includes a pin 82 that extends radially outwardly from tube 50 near its front end but at a position offset from port 74. In the illustrated embodiment, pin 82 is just to the rear of port 74 and extends at a radial angle (here 90° ) relative to port 74.

Figure 9:
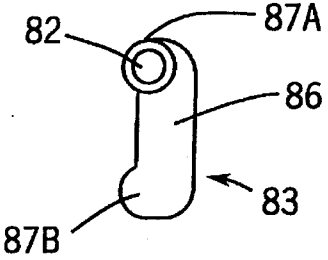
FIG. 9 is a flattened view of the pin and groove mechanism shown in FIG. 2.

The outer end of pin 82 slides within a circumferential groove 83 formed through bushing 52. Groove 83 is generally U-shaped, with a circumferentially elongated midportion 86 and a pair of end slots 87A, 87B that extend forwardly a short distance from opposite ends of midportion 86. End slots 87A, 87B are sized to retain pin 82 in its rearward travel position (FIG. 8) and its forward travel position (FIG. 9).

To start tool 10 for forward operation, the operator rotates the external air supply hose clockwise, thereby rotating tube 50 until pin 82 stops at the end of midportion 86 of groove 83. Port 74 of tube section 58 is not aligned with port 76 in bushing 52. Due to a spring force supplied by resilient outer tube 51, bushing 52 is pushed a short distance forward relative to tube 50 so that pin 82 is free to slide along midportion 86 of groove 83 and does not become engaged in either of end slots 87A, 87B. When compressed air is supplied through conduit 13, the air pressure acting on the front of bushing 52 overcomes the biasing force of outer tube 51 and secures the valve by causing pin 82 to slide a short distance forwardly into end slot 87A as shown in FIG. 9. In this position, air flow through port 76 is blocked and rotation of tube 50 relative to bushing 52 is prevented because pin 82 rests in a detent provided by end slot 87A.

Figure 8:
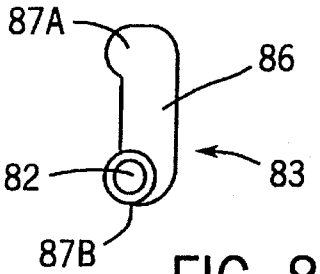
FIG. 8 is a flattened view of the pin and groove mechanism shown in FIG. 1.
Figure 7:
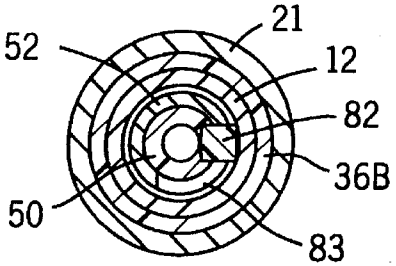
FIG. 7 is a cross-sectional view taken along the line VII—VII in FIG. 2.

To switch to reverse operation, the operator turns off the compressed air supply so that pin 82 moves back into midportion 86 of groove 83, and then rotates the air supply hose ninety degrees counterclockwise until pin 82 stops at the other end of midportion 86 of groove 83. Port 74 of tube 50 becomes aligned with port 76 in bushing 52 as shown in FIG. 2. To facilitate alignment and installation, the forward end of tube section 58 that includes port 74 may be tapered as shown. When the compressed air is turned back on, the pressure acting on the front of bushing 52 overcomes the spring force supplied by outer tube 51, and bushing 52 slides rearwardly relative to tube 50, causing pin 82 to move into its detent position in end groove 87B as shown in FIG. 8.

Bushing 52 acts as a floating valve member according to this design, i.e., can slide a short distance in the lengthwise direction of the tool relative to the inner tube 58. However, unlike prior art designs which switch to reverse mode by displacing the valve sleeve or bushing a substantial distance in the lengthwise direction of the tool, often using a spring force to bias the sleeve in the forward position, the present invention uses such a forward biasing force for an entirely different purpose, namely to move the sleeve over a very short distance, just enough to catch the pin in the end of the U-shaped slot when the air is turned back on. The resulting reversing mechanism can be switched from forward to reverse with a quarter turn of the air supply hose, yet provides high reliability due to its short range of movement and few moving parts.

In the described embodiment, the pin and groove mechanism acts as both a detent device and a front and rear stop mechanism that limit sliding of the bushing forming the valve member relative to the inner tube on which it is mounted. In the latter capacity, pin 82 is confined by the front and rear edges of the groove 83, and the length of end slots 87A, 87B thereby determines the range over which bushing 52 can slide.

It will be understood that the foregoing description is of preferred exemplary embodiments of the invention, and that the invention is not limited to the specific forms shown. For example, the resilient outer tube, such as an elastomeric hose, could be replaced by a coil spring, leaf spring or equivalent biasing means. Similarly, the pin and groove detent arrangement could be reversed so that the pin was formed on the inner surface of the bushing to move within a groove formed in the rotatable tube. These and other modifications may be made in without departing from the scope of the invention as expressed in the appended claims.

We claim:

1. A reversible pneumatic ground piercing tool, comprising:

an elongated body including a tubular housing and an anvil disposed at a front end of the housing;

a striker disposed for reciprocation within an internal chamber of the housing to impart impacts to a rear impact surface of the anvil for driving the tool forwardly through the ground;

an air distributing mechanism for effecting reciprocation of the striker, including a stepped air inlet conduit slidably disposed in a rearwardly opening recess in the striker, and a radial hole extending through a wall in the striker from the rearwardly opening recess;

a tail assembly mounted in a rear end opening of the housing that secures the striker and air distributing mechanism in the housing; and a reversing mechanism incorporated into the air distributing mechanism, in which the stepped conduit comprises:

a substantially rigid air supply tube rotatably mounted in the tail assembly, which tube supplies compressed air to the rearwardly opening recess in the striker;

a bushing slidably disposed on a forward end of the tube on its inside and the rearwardly opening recess of the striker on its outside;

a stop mechanism that limits sliding movement of the bushing relative to the air supply tube;

a reversing valve that can be opened and closed by rotating the air supply tube to supply compressed air to a first port located along a midportion of the bushing;

means for biasing the bushing to a forward position relative to the tube when the rearwardly opening recess in the striker is depressurized, and which biasing means is overcome by compressed air pressure when compressed air is supplied through the conduit to the rearwardly opening recess in the striker so that the bushing slides to a rearward position relative to the air supply tube; and a detent mechanism that secures the bushing from rotation relative to the air supply tube while the rearwardly opening recess in the striker is pressurized, and releases when the bushing slides forward under the force of the biasing means, permitting rotation of the inner tube relative to the bushing while the rearwardly opening recess in the striker is depressurized.

2. The tool of claim 1, wherein the biasing means comprises a resilient outer tube concentrically disposed outside of the air supply tube, the outer tube being mounted at its rear end to the tail assembly and at its front end to the bushing.

3. The tool of claim 2, wherein the resilient outer tube is in close conforming contact with the air supply tube but does not prevent rotation of the air supply tube.

4. The tool of claim 1, wherein the reversing valve comprises a first radial port formed near a front end of the air supply tube and a second radial port formed in the bushing, so that rotation of the air supply tube brings the first and second ports into and out of alignment.

5. The tool of claim 2, wherein the reversing valve comprises a first radial port formed near a front end of the air supply tube and a second radial port formed in the bushing, so that rotation of the air supply tube brings the first and second ports into and out of alignment.

6. The tool of claim 5, wherein the stop mechanism and detent mechanism comprise a pin extending from one of the air supply tube and the bushing into a groove in the other of the air supply tube and the bushing, the groove having a circumferential midportion that permits rotation of the tube between a forward mode position in which the reversing valve is closed and a rearward mode position in which the reversing valve is open, and further having a pair of end slots that extend from the ends of the midportion in the lengthwise direction of the tool, such that the pin becomes engaged in one of the end slots when the reversing mechanism is in a forward travel position and in the other end slot when the reversing mechanism is in a rearward travel position.

7. The tool of claim 6, wherein the groove is generally U-shaped.

8. The tool of claim 1, wherein the tail assembly comprises:

a tail nut threadedly secured to the inner periphery of the housing near a rear end opening thereof;

a resilient isolator secured inside the tail nut, the air supply tube being disposed inside the isolator; and means for preventing lengthwise movement of the air supply tube relative to the isolator while permitting rotation of the air supply tube inside the isolator.

9. The tool of claim 1, wherein the tail assembly comprises a tail nut threadedly secured to the inner periphery of the housing near a rear end opening thereof, a resilient isolator secured inside the tail nut, the air supply tube being disposed inside the isolator, and means for preventing lengthwise movement of the air supply tube relative to the isolator while permitting rotation of the air supply tube inside the isolator; and the biasing means comprises a resilient outer tube concentrically disposed outside of the air supply tube, the outer tube being mounted at its rear end to the isolator and at its front end to the bushing.

10. A reversible pneumatic ground piercing tool, comprising:

an elongated body including a tubular housing and an anvil disposed at a front end of the housing;

a striker disposed for reciprocation within an internal chamber of the housing to impart impacts to a rear impact surface of the anvil for driving the tool forwardly through the ground;

an air distributing mechanism for effecting reciprocation of the striker, including a stepped air inlet conduit slidably disposed in a rearwardly opening recess in the striker, and a radial hole extending through a wall in the striker from the rearwardly opening recess;

a tail assembly mounted in a rear end opening of the housing that secures the striker and air distributing mechanism in the housing, including a tail nut threadedly secured to the inner periphery of the housing near a rear end opening thereof, and a resilient, generally cylindrical isolator secured inside the tail nut;

a reversing mechanism incorporated into the air distributing mechanism, in which the stepped conduit comprises:

a substantially rigid air supply tube mounted in the isolator, which tube supplies compressed air to the rearwardly opening recess in the striker;

means for preventing lengthwise movement of the air supply tube relative to the isolator while permitting rotation of the air supply tube inside the isolator;

a bushing slidably disposed on a forward end of the air supply tube on its inside and the rearwardly opening recess of the striker on its outside;

a first radial port formed near a front end of the air supply tube and a second radial port formed along a midportion of the bushing, so that rotation of the air supply tube brings the first and second ports into and out of alignment to supply compressed air through the second port;

a resilient outer tube concentrically disposed outside of the air supply tube, the outer tube being mounted at its rear end to the tail assembly and at its front end to the bushing, the resilient outer tube biasing the bushing to a forward position relative to the tube when the rearwardly opening recess in the striker is depressurized, and which biasing is overcome by compressed air pressure when compressed air is supplied through the conduit to the rearwardly opening recess in the striker so that the bushing slides to a rearward position relative to the tube; and a detent mechanism that secures the bushing from rotation relative to the air supply tube while the rearwardly opening recess in the striker is pressurized and permits the air supply tube to rotate relative to the bushing while the rearwardly opening recess in the striker is depressurized, including a radial pin extending from the air supply tube into a groove in the bushing, the groove having a circumferential midportion that permits rotation of the tube between a forward mode position in which the first and second ports are out of alignment and a rearward mode position in which the first and second ports are out of alignment, and further having a pair of end slots that extend from the ends of the midportion in the lengthwise direction of the tool, such that the pin becomes engaged in one of the end slots when the reversing mechanism is in a forward travel position and in the other end slot when the reversing mechanism is in a rearward travel position.

* * * * *